US005531375A

United States Patent [19]

Palm

[11] Patent Number: 5,531,375

[45] Date of Patent: Jul. 2, 1996

[54] PACKAGING CONTAINER AND BLANK FOR PRODUCING THE SAME

[75] Inventor: Lars-Erik Palm, Lund, Sweden

[73] Assignee: Tetra Laval Holdings & Finance SA, Pully, Switzerland

[21] Appl. No.: 324,970

[22] Filed: Oct. 18, 1994

[30] Foreign Application Priority Data

Nov. 3, 1993 [SE] Sweden ..... 9303628

[51] Int. Cl.[6] ..... B65D 5/08

[52] U.S. Cl. ..... 229/137; 229/109; 229/110

[58] Field of Search ..... 229/109, 110, 229/137, 138, 132, 125.19

[56] References Cited

U.S. PATENT DOCUMENTS

| | | | |
|---|---|---|---|
| 2,047,804 | 7/1936 | Shapiro | 229/138 |
| 3,071,308 | 1/1963 | Lange . | |
| 3,109,574 | 11/1963 | Lange . | |
| 3,253,767 | 5/1966 | Pellaton . | |
| 3,325,961 | 6/1967 | Lindh et al. . | |
| 3,450,331 | 6/1969 | Tapiovaara . | |
| 3,743,165 | 7/1973 | Hopkins | 229/109 |
| 3,977,594 | 8/1976 | Swan | 229/110 |
| 4,272,009 | 6/1981 | Bamburg et al. | 229/125.19 |
| 4,392,607 | 7/1983 | Perkins, Jr. | 229/109 |
| 4,502,624 | 3/1985 | Burrell | 229/109 |

FOREIGN PATENT DOCUMENTS

| | | |
|---|---|---|
| 25235 | 3/1981 | European Pat. Off. . |
| 1152944 | 8/1963 | Germany . |
| 2088338 | 6/1982 | United Kingdom . |

*Primary Examiner*—Allan N. Shoap
*Assistant Examiner*—Christopher J. McDonald
*Attorney, Agent, or Firm*—Burns, Doane, Swecker & Mathis

[57] ABSTRACT

Packaging containers for beverages, for example milk or juice, as well as blanks for producing the packaging containers, are often manufactured from paper-plastic laminate which, by fold forming and sealing, is given the desired container configuration, normally parallelepipedic. With the aid of a specifically designed pattern of fold or crease lines which divide the material into, for example, six side panels (1) and associated primary end panels (7) and secondary end panels (8), respectively, prismatic, preferably hexagonal containers may instead be produced using substantially known methods.

21 Claims, 3 Drawing Sheets

PACKAGING CONTAINER AND BLANK FOR PRODUCING THE SAME

FIELD OF THE INVENTION

The present invention relates to packaging containers and more particularly to packaging containers having a number of side wall panels in excess of four.

The invention also relates to a packaging container blank for producing said packaging container, the packaging container blanks being divided by means of a number of crease lines into three transverse zones, namely a central zone which comprises a number of side wall panels and a longitudinal sealing panel, and two end zones located on either side of this central zone, each one of which comprising a number of end panels, and a transverse sealing panel, the end zone including at least one primary end panel and secondary end panels located on either side thereof.

BACKGROUND OF THE INVENTION

Packaging containers for milk, juice or other beverages are produced in consumer sizes from laminated paper-plastic material which is folded and sealed into packaging containers of the desired shape. A particularly common packaging container is manufactured from a flexible packaging material web which is provided with crease lines and is progressively reformed into a tube and provided with a longitudinal liquid-tight seal. The tube is filled with the desired contents, whereafter at regular spaces it is pressed flat and transversely sealed for the formation of substantially cushion-shaped packaging containers filled with contents. These are thereafter separated from the tube and reformed, int. al. by flat pressing and downward folding of triangular corner flaps, into a parallelepipedic packaging container of known type. The above-described production principle, together with a machine for manufacturing the above container type is described in greater detail in U.S. Pat. No. 3,325,961 and European Patent EP 25235, which are incorporated herein by reference.

The above-disclosed packaging container has, as previously mentioned, a characteristic parallelepipedic basic shape with flat-pressed, substantially triangular corner flaps folded down into abutment against the outside of the packaging container. This form has proved to be highly space efficient and suitable for the transport of large numbers of compactly packed packaging containers. Since the packaging container is, to a particularly high degree, employed for the packing of consumer milk, it has (within certain areas) been so closely related to this type of content that, from the point of view of public relations and distinguishing features, it may be deemed to be less appropriate for other types of contents. This applies in particular when the intention is to pack more expensive and more exclusive products, such as flavoured, refined dairy produce, wine, coffee or tea.

The conventional parallelepipedic package which has been described above displays relatively large side wall panels which the consumer grasps when the packaging container is to be opened and the contents dispensed. In order to avoid the risk, in this operation, that the side wall panels are pressed together more than is desirable, the packaging container must be manufactured from a relatively thick packaging laminate. Alternatively, the packaging container may be designed so that the size of the side wall panels is reduced, which has however proved to be difficult when the current parallelepipedic packaging form is employed for larger volumes.

The above-mentioned, previously known parallelepipedic packaging container is also produced in an aseptic version for packing previously sterilised contents, which hereby obtain, in the packed state, a considerably longer shelf life. Machines and material for producing such aseptic packaging containers are well tested in practice and have proved to possess extraordinarily good reliability and economy.

OBJECTS AND SUMMARY OF THE INVENTION

One object of the present invention is to devise a packaging container which, despite fundamentally utilising the above-mentioned known techniques, does not suffer from the drawbacks cited above in respect of the known parallelepipedic packaging container.

A further object of the present invention is to devise a packaging container which has a distinguishing profile which is characteristic and easy to recognise and which sets itself apart from previously known liquid-tight packaging containers manufactured from flexible paper-plastic laminate.

Still a further object of the present invention is to devise a packaging container which is easy to handle in both transport in batch containers and in individual handling by the consumer.

Yet a further object of the present invention is to devise a packaging container of the above-disclosed type which is easy to grasp and has side wall panels of limited size, thus minimising the risk of undesired compression and making it possible to reduce the thickness of the packaging laminate.

The above and other objects have been attained according to the present invention in that a packaging container of the type disclosed has been given the characterizing feature that the sealing fin, in two material layers bonded to one another in liquid-tight fashion, interconnects edge regions of both the primary end panels and the secondary end panels with one another throughout the entire flat-laid width of the packaging container.

A further object of the present invention is to devise a packaging container blank which is designed for manufacture of the above-disclosed packaging container.

Still a further object of the present invention is to devise a packaging container blank which, by means of crease lines, is divided into panels formed in such a way that reforming of the planar blank into a finished packaging container is facilitated to the maximum degree.

The above and other objects have been attained according to the present invention in that a packaging container blank of the type disclosed has been given the characterizing feature that the primary end panel forms an extension of a first side wall panel, a number of secondary end panels constituting a continuation of at least two second side wall panels located in the central zone. set forth in appended subclaims 15 and 16.

By designing the packaging container and packaging container blank according to the invention, there will be realised a packaging container possessing a characteristic prismatic shape which, even though the production principle largely coincides with that which applies to the above-described known parallelepipedic packaging container, differs in terms of appearance considerably therefrom. Hereby, a liquid-tight packaging container which is of novel appearance and is suitable for beverages or other contents can be produced with the aid of substantially tried and tested methods which have proved to be reliable and efficient. The prismatic, preferably hexagonal or octagonal configuration of the packaging container (in addition to the two end walls) also imparts a stability which, in a given volume, makes it possible, without risk of undesirable compression, to reduce the thickness of the packaging laminate in relation to the above-mentioned parallelepipedic packaging container.

BRIEF DESCRIPTION OF THE ACCOMPANYING DRAWINGS

Preferred embodiments of the packaging container and packaging container blank according to the invention will now be described in greater detail with particular reference to the accompanying, schematic Drawings, which show only those details indispensable for an understanding of the invention.

DESCRIPTION OF PREFERRED EMBODIMENTS

Figure 1:
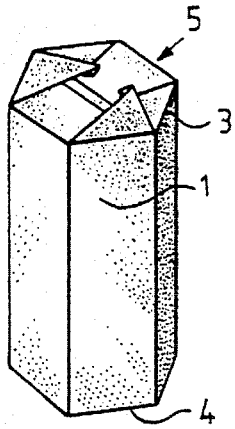
FIG. 1 is an isometric view of a first (hexagonal) embodiment of a packaging container according to the invention.
Figure 2:
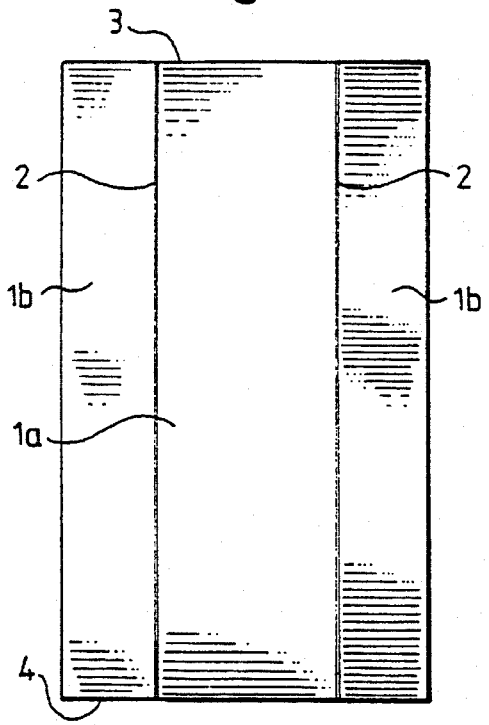
FIG. 2 is a side view of the packaging container according to FIG. 1.
Figure 6:
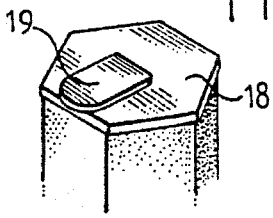
FIG. 6 is an isometric view of the upper end of the packaging container according to the invention provided with a first type of end section.

The preferred embodiments of the packaging container according to the invention as shown in FIGS. 1–12 are manufactured from a packaging laminate which comprises a core layer of paper which is coated on either side with thin layers of thermoplastic material, for example polyethylene. The packaging laminate may also include further layers of barrier material, for example aluminium foil. This type of packaging laminate is previously known and is employed for different types of packaging containers, for instance the parallelepipedic packaging container which is marketed under the trademark Tetra Brik® and which is described, for example, in patent specifications U.S. Pat. No. 3,325,961 and EP 25235.

The packaging container according to the invention is substantially of the form of a straight, regular prism which is preferably hexagonal or octagonal or, in any event, has a number of sides in excess of four. In addition to the side surfaces there are two substantially planar end regions or end walls, and the expressions "hexagonal" and "octagonal" are hereinafter employed to indicate the number of side wall panels bordering on the end regions. The side surfaces of the prism or the packaging container coincide with side wall panels which are substantially planar (and preferably rectangular), but may in their turn also be divided (by means of a suitable crease line pattern) into a number of part panels. The base surfaces of the prism correspond to the end regions of the packaging container, which preferably are of regular polygonal shape.

The side surfaces or side wall panels can, as has been mentioned, also be divided into a number of part panels by means of a desired crease line pattern, so as to create a plurality of variations in the basic form of the packaging container in terms of appearance. Even though the individual side wall panels in the illustrated preferred embodiments are preferably of rectangular configuration, the side wall panels may thus throughout the greater part of the distance between the two end regions, be given substantially any optional shape, with triangular, oval or oblique panels. The major factor is simply that the parts of the side wall panels bordering on the side regions, i.e., those parts of the side wall panels which are separated from adjacent end panels by means of a substantially straight, common crease lines amount to a number exceeding four. In such instance, it is also possible to design the packaging container with top and bottom sections of different forms, e.g. a hexagonal top and an octagonal or quadrilateral bottom. Of course, one of the end regions may also be designed in a completely deviating manner, for example by providing it with a prefabricated plastic top, an injection moulded plastic end piece or the like. Neither the above-mentioned end wall types nor end walls such as the hexagonal or octagonal end walls formed by folding of the packaging material need be symmetric. It is thus entirely possible to give the end regions asymmetric form, for example pentagonal so as to provide better space for an opening arrangement or so as to improve the capabilities of pouting the product from the package.

The packaging container according to the invention comprises, in the preferred embodiments, a number, preferably six or eight, of mutually bordering, substantially planar side wall panels 1 which are separated from one another by means of vertical crease lines 2. The upper and lower defining lines of the side wall panels 1 consist of an upper, horizontal crease line 3 and a corresponding, lower horizontal crease line 4. The horizontal crease lines 3 and 4 each define their end region 5, 6 which, as has previously been mentioned, are of polygonal regular shape with six or eight edge lines of equal length.

The end regions 5, 6 each comprise two primary end panels 7 which, by means of parts of the crease lines 3, 4, are each defined from their adjacent, first side wall panel 1*a*. Each end region 5, 6 moreover includes a number of secondary end panels 8 which connect the primary end panels 7 with second side wall panels 1*b* and a sealing fin 9 which connects in a liquid-tight manner the free edge regions of both the primary end panels 7 and the secondary end panels 8 with one another. Thus, the sealing fin extends throughout the entire width of the packaging container, which is a precondition for reliably being able to realise a completely liquid-tight end design. As is apparent from FIGS. 3 and 4, the end panels 7, 8 of both end regions 5, 6 are folded down and connected to the outside of the packaging container in order to provide substantially planar end regions. This is made possible by the crease line pattern of the end regions 5, 6, which divides the end regions 5 and 6 of the packaging container not only into the previously mentioned primary end panels 7 and secondary end panels 8, but also into refold panels 10 which constitute parts of the secondary end panels 8 and make possible double-folding (180°), so that planar end surfaces are obtained. This feature will be described in greater detail hereinbelow, with particular reference to FIGS. 5 and 11.

Figure 5:
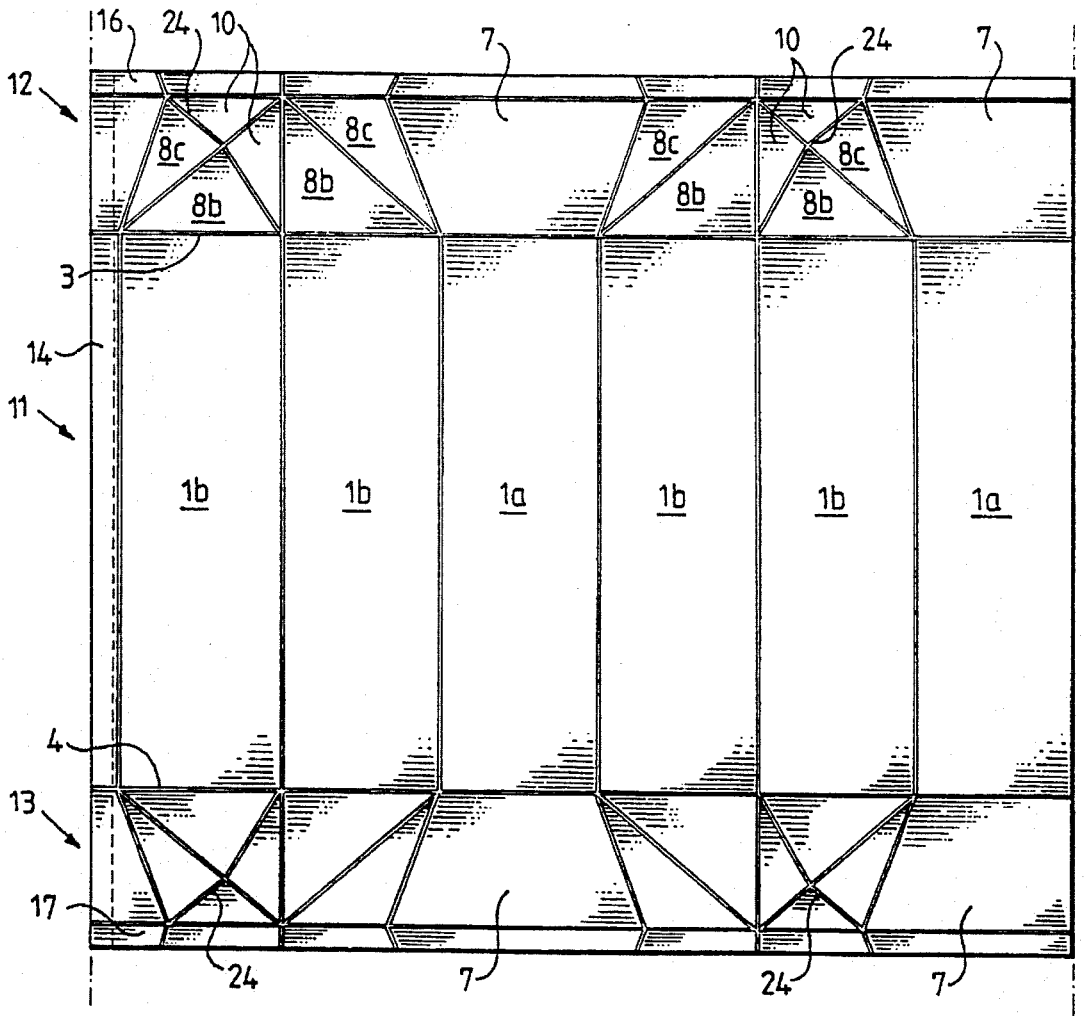
FIG. 5 is a top view of a packaging container blank for manufacturing the first embodiment of the packaging container according to the invention.
Figure 11:
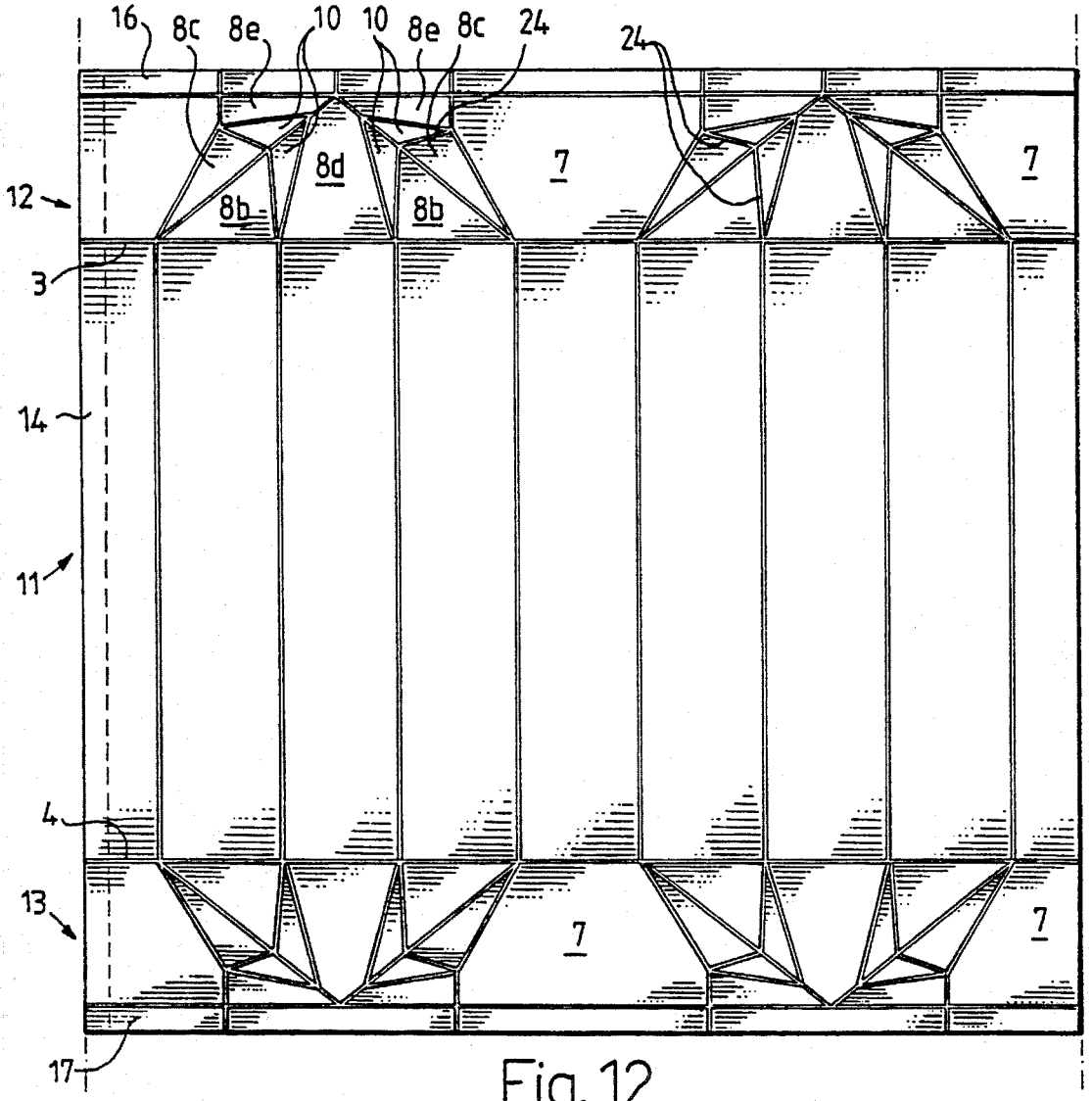
FIG. 11 is a top view of a packaging container blank for manufacturing a second (octagonal) embodiment of the packaging container according to the invention.
Figure 12:
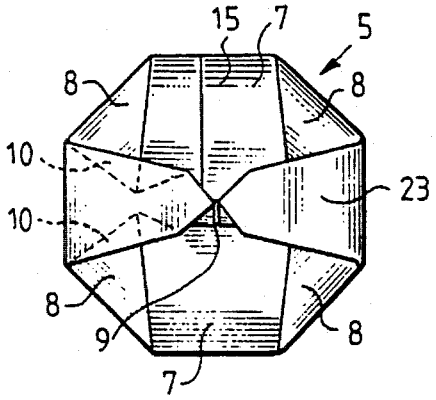
FIG. 12 is an end elevation of a packaging container according to the invention manufactured from a packaging container blank according to FIG. 11.

FIG. 5 shows one preferred embodiment of a packaging container blank for producing a packaging container provided with six side wall panels according to FIGS. 1–4. The corresponding packaging container blank for producing a packaging container with eight side wall panels is shown in FIG. 11. The packaging container blank constitutes a part of a packaging material web, which in practice would be connected as indicated in FIGS. 5 and 11 with a large number of identical blanks. For purposes of clarity but one individual blank spread out in the flattened state is shown here. The packaging container blank is, with the aid of the previously mentioned upper and lower horizontal crease lines 3 and 4, respectively, divided into three zones, namely a central zone 11, which, at opposing sides, borders on an upper end zone 12 and a lower end zone 13. The terms upper and lower, respectively, naturally refer to the orientation of the finished packaging container. The central zone 11 comprises preferably six (or alternatively eight) rectangular side wall panels defined with the aid of the vertical crease lines 2, and a sealing panel 14 which is located along the one longitudinal edge of the packaging container blank (or material web, respectively) and which also extends over the corresponding edge regions of both of the end zones 12, 13. The upper and lower end zones 12 and 13, respectively are basically identical apart from possible opening arrangements in the upper end zone 12, as will be described in greater detail below. Both the upper and lower end zones 12 and 13 thus include the previously mentioned, substantially trapezoid (FIG. 5) or hexagonal (FIG. 11 ) primary end panels 7 which constitute an extension of two first side wall panels 1*a*. In the embodiment shown in FIG. 11 one of the two first side wall panels la, like associated primary end panels 7, is divided into two parts, this being related to the fact that the spread-out packaging container blank is subsequently reformed into hose or tube form, the longitudinal sealing panel 14 being then utilized to seal both of the longitudinal edges of the web in a longitudinal lap joint or seal 15 (the overlap region is indicated by broken lines). Once the blank is formed into a tube, both of the first side wall panels 1*a* with associated primary end panels will thus be of identical configuration.

As mentioned previously, there are disposed, between the two first side wall panels la, a number (preferably two groups) of second side wall panels 1*b* (two in number in each respective group in the hexagonal embodiment and three in each respective group in the octagonal embodiment), these panels merging, in the upper and lower end zones 12, 13 respectively, into a number of primary end panels 8. In the hexagonal packaging container, the secondary end panels are substantially triangular and symmetrically disposed in relation to the vertical crease line 2 which, in each group defines two mutually bordering second side wall panels 1*b* from one another. Most proximal thereto, there are thus two substantially isosceles and fight-angled secondary end panels 8*b* which border on two similarly triangular secondary end panels 8*c* which, in turn, border on adjacent primary end panels 7. Each one of the secondary end panels 8*b*, 8*c* bordering on the one primary end panel 7 of the packaging container blank (the corresponding applies for the opposite end of the blank), is moreover divided, by means of a crease line 24 extending between the horizontal crease lines 3, 4 and adjacent, transverse sealing panels 16, 17, into a main section and a triangular refold panel 10 which, on reforming of the blank, is folded in under adjacent, undivided secondary end panels so that realization of substantially planar end regions 5, 6 is made possible (i.e. end regions without projecting portions which prevent the packaging container from standing steadily). The secondary end panels 8*c* border on the upper and lower transverse sealing panels 16, 17 of the packaging container blank, respectively, these panels being utilised for the above-disclosed liquid-tight sealing of the free end regions of the packaging containers in transverse sealing fins 9. The extensions of the vertical crease lines 2 extending over both of the end zones 12, 13, also extend over the two transverse sealing panels 16, 17 in order to facilitate their folding in connection with forming of the packaging container.

The octagonal embodiment of the packaging container according to the invention differs from the above-disclosed hexagonal embodiment among other things in that it has two additional side wall panels 1*b* (one in each group), which, at the upper and lower horizontal crease lines 3, 4, respectively, merge into secondary end panels 8*d* which are located between the previously mentioned secondary panels 8*b*, c and secondary panel 8*e* which, for reasons of folding geometry, are placed between the upper secondary end panels and the transverse sealing panels 16, 17. The previously mentioned triangular secondary end panels 8*b*, 8*c* are of substantially the same configuration as in the hexagonal packaging container, but are slightly more elongate so that their apex facing towards the sealing panels 16, 17 are partly directed towards one another. Also in this embodiment, the secondary panels 8*b*, 8*c* are divided into main section and a triangular refold panel 10, this latter being folded in beneath corner flaps 23 formed by the panels 8*d*, 8*e*, as will be described in greater detail below.

In the manufacture of a packaging container according to the invention using a packaging material web which is divided, by .means of the described crease line pattern, into packaging container blanks according to FIG. 5 or FIG. 11, the packaging material web is first converted by longitudinal folding into hose or tube form, its two longitudinal edges being brought to overlap slightly. By heating of the longitudinal edge regions of the packaging laminate to a temperature at which the external layers of the packaging laminate consisting of thermoplastic material become fusible, together with subsequent compression, the longitudinal sealing panel 14 is fused together with the opposing, longitudinal edge of the packaging material tube so that a liquid-tight, durable longitudinal seal 15 is obtained. In the illustrated embodiment of the hexagonal packaging container according to the invention, the longitudinal seal 15 is placed along one of the vertical crease lines 2, but it is self-evident that placing of the longitudinal seal 15 may vary, for example the seal 15 may be placed centrally on one of the side wall panels 1 (as shown in the octagonal packaging container according to FIGS. 11 and 12). Several longitudinal seals are also naturally conceivable.

As soon as the packaging material has been reformed into a liquid-tight tube, this is filled with liquid contents to the desired level. Hereafter, the packaging material tube is pressed flat in transverse sealing zones which are preferably located below the level of the above-mentioned contents if the intention is to produce fully filled packaging containers, i.e. packaging containers with no head-space. In the flattened regions, transverse seals (corresponding to the sealing panels 16, 17) are provided with the aid of sealing jaws which include means for heating the internal mutually abutting layers of thermoplastic material so that these are fused to one another in a liquid-fight manner. There will hereby be created flat-pressed regions which will, in due course, form sealing fins which, without any change in thickness (apart from the intersection with the longitudinal joint or seam), extend over the entire flat-laid width of the forthcoming packaging container and which divide the packaging material tube into a row of continuous, substantially pillow-shaped packaging containers which are completely filled with contents. Since the sealing fins are formed by a (substantially rectilinear) incision through each flat-pressed sealing zone, no material wastage occurs, which is important since it is difficult, in the continuous production of packaging containers from a web or tube, to take care of individual pieces or lengths of waste material. The pillow-shaped packaging containers are thereafter separated from one another by means of incisions in the transverse, sealed zones, whereafter further forming work takes over with a view to reforming the substantially pillow-shaped packaging container into the desired prismatic configuration. The conversion of the packaging material web into pillow-shaped, filled and sealed packaging containers is substantially identical to the method of production as disclosed and described in the previously mentioned patent specifications.

While maintaining the main principles of the above described manufacturing process, it is also possible, during the manufacturing process, to produce fillable packaging container blanks. These are in the form of packaging containers open at one end, which may be filled with the desired quantity of contents in a conventional packing and filling machine of the type which, by means of a compartmented conveyor, stepwise advances prefabricated packaging container blanks between stations for, for example, filling and top-sealing. This manufacturing principle is normally slower in output, but may be appropriate in limited series manufacture of not entirely filled packaging containers.

The reforming of the liquid-tightly sealed, pillow-shaped packaging containers into the desired prismatic final shape takes place stepwise utilising the previously described pattern of crease lines facilitating fold formation. More precisely, a reforming of the central zone 11 of the packaging container takes place first, in that both groups of second side wall panels 1*b* are caused, with the aid of forming tools (not shown), to approach one another and assume the correct mutual angle of preferably 120° and 135° respectively. This reforming of the final packaging container entails that the two opposing first side wall panels 1*a* are distanced from one another at the same time as the primary end panels 7 are progressively caused, because of the increasing distance between both of the first side wall panels, to assume a position substantially flush with one another. The corner flaps 23 are formed in that the secondary panels are pressed flat against one another and, as a result of pivoting of the secondary end panels 8 about associated parts of the upper and lower horizontal crease lines 3 and 4, respectively, a downward folding of the corner flaps is commenced, this also involving the refold panels 10 so that the secondary end panels 8 provided with refold panels 10 are placed partly beneath the previously mentioned, downwardly folded secondary end panels. The corner flaps 23 are thereafter sealed to the end regions 5, 6 of the packaging container, in that the outer tips of the corner flaps on both end portions of the sealing fin 9 are heat-sealed or fused to subjacent primary end panels 7. After this operation, both end regions of the packaging container will have a substantially planar configuration, this being achieved in that both of the primary end panels 7 are pressed slightly inwards in the packaging container in connection with the reforming operation, so that the downwardly folded and sealed corner flaps do not project outside the profile defined by the crease lines 3, 4 of the packaging container, as is apparent from FIG. 2. Reforming of both end sections of the packaging container may be effected separately or simultaneously, depending upon the type of mechanical equipment employed. The reforming of the end sections thus proceeds substantially in the same manner in the hexagonal as in the octagonal version of the packaging container according to the present invention. However, as a result of the differences in the crease line pattern, the downwardly folded corner flaps 23 will lie in register with one another in the octagonal version, since the refold panels 10 are symmetrically disposed on either side of each secondary end panel 8*d*.

After the reforming of both end regions of the packaging container, the packaging container is basically finished. However, in most cases, it is desirable to provide the packaging container with some form of opening arrangement which may be of per se known type, for example a pull-tab, a screw cap or the like. FIGS. 6–10 show a number of examples of opening arrangements which may be applied to a packaging container according to the invention. The packaging container may, after reforming to the configuration illustrated in FIG. 1, be provided with an outer top 18 (hexagonal or octagonal) of plastic material covering the primary end panels and the corner flaps, the top being sealable to the outside of the packaging container. The top may be provided with an opening arrangement 19 in the form of a tear-off strip which affords access to a previously punched-out region of subjacent primary end panel 7 located beneath the top.

Figure 7:
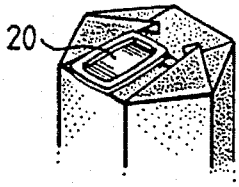
FIG. 7 is an isometric view of an upper portion of the packaging container according to the invention provided with a second type of end section.
Figure 3:
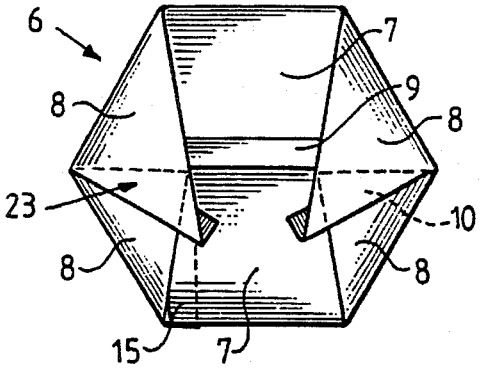
FIG. 3 is a bottom view of the packaging container according to FIG. 1.

As shown in FIG. 7, a packaging container which is not provided with a superjacent top 18 may be provided with an opening arrangement 20 in the form of an openable portion produced by injection moulding. This moulding being disposed in connection with the opening process (or in a separate operation) is torn off a subjacent portion of the primary end panel 7 so that the contents of the packaging container may be dispensed.

Figure 8:
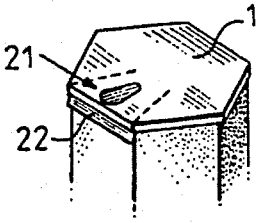
FIG. 8 is an isometric view of an upper portion of the packaging container according to the invention provided with a third type of end section.
Figure 4:
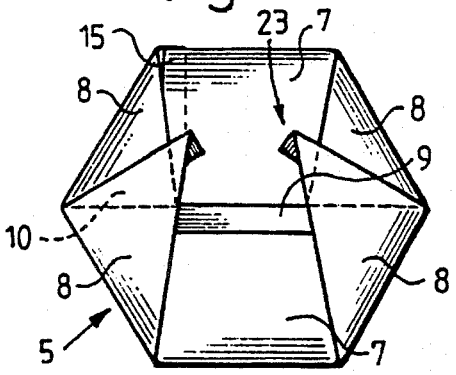
FIG. 4 is a top view of the packaging container according to FIG. 1.

As shown in FIG. 8, a portion of a top 18 may be designed in the form of an opening arrangement such that, for example, the top may include an openable portion 21 which is defined from the remaining surface of the top by means of indications of fracture or rupture. In order to facilitate opening, the top or a portion disposed beneath the top may be provided with a projecting edge or strip 22 which serves as gripping means when the packaging container is to be opened.

Figure 9:
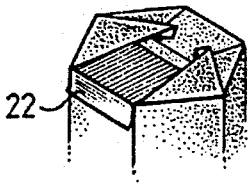
FIG. 9 is an isometric view of an upper portion of the packaging container according to the invention provided with a fourth type of end section.

FIG. 9 shows how this strip 22 may be placed on a packaging container with no outer plastic top 18 and cover a prepared pouring aperture.

Figure 10:
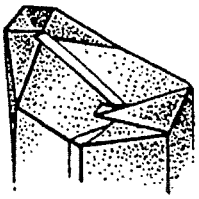
FIG. 10 is an isometric view of an upper portion of the packaging container according to the invention provided with a fifth type of end section.

FIG. 10 finally shows how a simple version of the packaging container according to the invention may quite readily be provided with an opening arrangement in the form of a tear-off portion of the one corner flap 23 which, after being folded out, serves as a pouring spout.

As will have been apparent from the foregoing description, the packaging container according to the invention differs from previously known parallelepipedic packaging containers manufactured in a similar way primarily in that the two opposing, first side wall panels 1*a* have therebetween (seen in the circumferential direction of the packaging container) at least two second side wall panels 1*b* located adjacent one another. Hereby, the packaging container will be of prismatic configuration, with at least five side surfaces, as well as two base surfaces disposed at right angles thereto. The mutual width of the side surfaces may be varied, and similarly, for example, the central portion of the packaging container may be made more or less circular in that the vertical crease lines 2 are discontinued or have a less pronounced central region. In that the mutually bordering second side wall panels 1*b* in the upper and lower end regions 5 and 6 of the packaging container border on secondary panels (of which certain are, in their turn, divided into refold panels), a downward folding is made possible of all secondary end panels 8 located at each respective packaging container end, so that substantially planar end regions can be realised. This for geometric reasons, has hitherto only been possible in parallelepipedic packaging containers where each flat-pressed corner flap can, in its entirety, be folded down and secured to the outside of the packaging container without any difficulties in forming. Even though prismatic, e.g. hexagonal and octagonal packages, respectively, are previously known in the art, such packages have not proved to be liquid-tight, principally because it has not been possible to realise a liquid-tight sealing fin extending throughout the entire width of the package. Nor have previous types of prismatic packaging containers been produced with end regions which are planar, i.e. do not project out beyond the contour of the packaging container and destabilise its possibilities of standing upright on a flat surface. Thus, the present invention makes it possible to realise a packaging container which, despite being substantially manufactured using known and tested technology and methods, is of a completely novel configuration which provides better stability and which opens up possibilities for improved profiling of certain types of goods. Thanks int. al. to the design of the transverse sealing fins with but two liquid-tight sealed material layers, which, without thickness transitions, (for example from four to two and back to four layers, as is the case in prior art so-called gable-top packages or cartons) extend throughout the entire flat-laid width of the packaging container, the packaging container will moreover be of a tightness which, even from the aseptic point of view, is well comparable with similar, parallelepipedic packaging containers, thus making it suitable also for the packing of previously sterilised contents.

While the invention has been illustrated and described in accordance with preferred embodiments it is recognized that variations and changes may be made therein without departing from the invention as set forth in the claims.

What is claimed is:

1. A packaging container comprising:

at least two main side wall panels and at least two other side wall panels, the total number of side wall panels being in excess of four;

a first end region and a second end region;

said first end region including two primary end panels adjacent said at least two main side wall panels and defined from said adjacent main side wall panels by crease lines, a plurality of secondary end panels which interconnect with the primary end panels and with the other side wall panels, and a sealing fin; and said sealing fin being arranged for sealing edge regions of both the primary end panels and the secondary end panels with one another in a continuous double layer seal over the entire flat-laid width of the packaging container.

2. The packaging container according to claim 1, further comprising a horizontal crease line defining each end region, and substantially parallel vertical crease lines extending between the end regions, said vertical and horizontal crease lines together defining the main and other side wall panels.

3. The packaging container according to claim 1, wherein the packaging container has six quadrilateral side wall panels.

4. The packaging container according to claim 3, wherein the side wall panels make angles of 120° in relation to adjacent side wall panels.

5. The packaging container according to claim 1, wherein the packaging container has eight quadrilateral side wall panels.

6. The packaging container according to claim 5, wherein the side wall panels make angles of 135° in relation to adjacent side wall panels.

7. The packaging container according to claim 1, wherein at least one of the side wall panels is provided with a longitudinal seal.

8. The packaging container according to claim 1, wherein the secondary end panels form flat-laid corner flaps which are folded down towards and sealed to the outside of the packaging container.

9. The packaging container according to claim 8, wherein the corner flaps are sealed to the first end region of the packaging container.

10. The packaging container according to claim 8, wherein the first end region is provided with a top covering both primary end panels and corner flaps.

11. The packaging container according to claim 8, wherein an opening arrangement is located on one of the primary end panels not covered by the downwardly folded corner flaps.

12. The packaging container according to claim 1, wherein two of the secondary end panels include triangular refold panels.

13. The packaging container according to claim 1, wherein one of said first and second end regions includes an opening arrangement.

14. The packaging container according to claim 1, wherein the sealing fin is of an elongated rectangular shape.

15. A packaging container blank comprising:

a central zone which comprises more than four quadrilateral side wall panels and a longitudinal sealing panel; and two end zones located on either side of the central zone, each of said end zones comprising a transverse sealing panel, at least one primary end panel and a plurality of secondary end panels disposed on either side of the primary end panel, said primary end panel forming an extension of a first side wall panel and said secondary end panel forming a continuation of at least two second side wall panels located in the central zone, wherein the transverse sealing panels are linear and continuous over the entire flat-laid width of the packaging container.

16. The packaging container blank according to claim 15, wherein said secondary panels comprise triangular refold panels separated by crease lines.

17. The packaging container blank according to claim 15, wherein the primary end panels are trapezoid.

18. The packaging container blank according to claim 15, wherein the primary end panels are hexagonal.

19. The packaging container according to claim 15, wherein the transverse sealing panels are of an elongated rectangular shape and extend along an entire width of the end zones.

20. A packaging container comprising:

at least two main side wall panels and at least two other side wall panels, the total number of side wall panels being in excess of four, the side wall panels being joined to one another along their lengths;

a first end region located at one end of said side wall panels and a second end region located at an opposite end of said side wall panels;

said first and second end regions including two primary end panels adjacent said at least two main side wall panels and defined from said adjacent main side wall panels by crease lines, a plurality of secondary end panels which interconnect with the primary end panels and with the other side wall panels, and a sealing fin; and said sealing fin being arranged at an edge of the primary end panels opposite said at least two main side wall panels and at an edge of the secondary end panels for sealing edge regions of both the primary end panels and the secondary end panels with one another in a continuous double layer seal over the entire flat-laid width of the packaging container.

21. The packaging container according to claim 20, wherein the sealing fin is of an elongated rectangular shape.

* * * * *